US005528006A

United States Patent [19]

Gonin et al.

[11] Patent Number: 5,528,006

[45] Date of Patent: Jun. 18, 1996

[54] SWITCHING DEVICE FOR OPENING AND CLOSING AN ELECTRICAL PATH

[75] Inventors: Pascal Gonin, La Verpilliere; Vincent Eudeline, Villefontaine, both of France

[73] Assignee: Radiall, Rosny Sous Bois, France

[21] Appl. No.: 398,601

[22] Filed: Mar. 3, 1995

[30] Foreign Application Priority Data

Mar. 4, 1994 [FR] France ..... 94 02506

[51] Int. Cl.[6] ..... H01H 5/00; H01H 15/00

[52] U.S. Cl. ..... 200/16 A; 200/447

[58] Field of Search ..... 200/16 A, 405–409, 200/434, 435, 439, 445, 446, 449, 447, 448, 302.1

[56] References Cited

U.S. PATENT DOCUMENTS

| | | | |
|---|---|---|---|
| 2,472,333 | 6/1949 | Kohl | 200/16 A X |
| 2,473,970 | 6/1949 | Riche | 200/447 |
| 3,582,594 | 6/1971 | Twyford | 200/341 |
| 3,769,474 | 10/1973 | Deubel et al. | 200/447 |
| 3,973,094 | 8/1976 | Kuhn | 200/443 |
| 4,152,563 | 5/1979 | Bongort | 200/283 X |
| 4,224,489 | 9/1980 | Dietrich | 200/16 A X |

*Primary Examiner*—J. R. Scott
*Attorney, Agent, or Firm*—Schweitzer Cornman & Gross

[57] ABSTRACT

A compact snap-action switch for high frequency switching applications comprising a housing of electrically conductive material having a horizontal outer wall with an opening formed therein; two spaced contact terminals disposed within the housing and having contact surfaces in a common plane proximate to and parallel with the plane of the outer housing wall; a rectangular metal contact element adapted to bridge the gap between the contact surfaces of the contact terminals in a closed position and to be snapped into an open position spaced from the contact surfaces; an actuator element having a lower end portion supporting the rectangular metal contact element and having an upper end portion disposed above the housing; a cradle support for the operating member; two parallel flexible strips being freely supported therein and being secured to the operating member; the cradle support being mounted above the outer housing wall and accommodating limited vertical displacement of the operating member between a switch closing position in which the metal contact element contacts the spaced contact terminal surfaces and a switch opening position in which the metal contact element is spaced above the contact terminals; the parallel flexible strips normally biasing the operating member in a direction away from the contact surfaces; the parallel flexible strips being parallel to one another and forming with the operating member three sides of a parallelogram in a manner whereby the flexion of the flexible strips provides strictly axial translation of the operating member between the switch opening and the switch closing positions.

5 Claims, 3 Drawing Sheets

SWITCHING DEVICE FOR OPENING AND CLOSING AN ELECTRICAL PATH

BACKGROUND OF THE INVENTION

The present invention relates to a switching device for opening and closing an electrical path, especially a high-frequency switch able to operate equally well with DC low, medium or high-frequency signals.

Switching devices are already known for opening and closing an electrical line, in which devices a contact piece, in the form of a strip, is supported by an operating member which can move in terms of translation between a position in which said contact piece rests against two contact terminals, closing the electrical path, and a position in which it is separated from said contact terminals, opening the electrical path.

During its translational movements, the contact piece is guided by rods along which it slides, so as to ensure that said contact piece is correctly applied against the contact terminals.

Such guidance does, however, present the drawback that friction exerted between the contact piece and its guide rods produces dust which can become deposited on the electrical contact surfaces and can, over time, impair the reliability of the switching device.

Document DE-A-2,417,280 discloses a switch for a key of an electric typewriter keyboard, in which the operating member bearing the contact piece is guided by two parallel flexible strips which are set into a fixed support.

In such a switch, friction is avoided.

There is, however, the problem that the support for the two flexible strips has to be offset relative to the axis of movement of the operating member, owing to the length of the strips which has to be sufficient for these to exhibit the required elasticity.

Another problem inherent to this known switch arises out of the fact that the flexible strips, which form a parallelogram, guide the operating member not in a strictly axial direction, but in a circular translational movement.

For this reason, bringing the contact piece into contact with the contact terminal is accompanied by a slight amount of slippage which may impair the quality of the electrical contact.

The present invention aims especially to solve these problems.

SUMMARY OF THE PRESENT INVENTION

The subject of the present invention is a switching device for opening and closing an electrical path, including two contact terminals, an operating member including a contact piece, able to be moved axially between a closed position in which the contact piece is applied simultaneously to the two contact terminals, electrically connecting them, and an open position in which the contact piece is separated from the two contact terminals, and two parallel flexible strips integral with said operating member, wherein the central part of each flexible strip is integral with the operating member and each of the ends of each flexible strip is housed in a cradle of a support.

In accordance with the invention, the operating member is situated in the central part of each flexible strip, that is to say in that part of the flexible strips where their amplitude of deformation is a maximum along the axis of movement of the operating member.

By virtue of the invention, the switch may have a small overall size owing to the fact that the support for the flexible strips can be centered relative to the operating member, for example being placed above the two contact terminals of the switch.

Thus, a switch can be produced whose overall surface area is limited substantially to a rectangle whose length corresponds substantially to the separation of its two contact terminals and whose width corresponds substantially to that of the contact piece which connects the two contact terminals.

In this way, several switches according to the invention can be positioned side by side on one and the same printed circuit card.

Furthermore, the fact that, in accordance with the invention, the two flexible strips are housed at their ends in a cradle of a support, and not set in, makes it possible to create a pivoting link between the support and the ends of the strips. This pivoting link gives the strips increased flexibility without them having to have a significant length.

The problem of the axial movement of the operating member is also solved by virtue of the invention, the symmetry of the layout of the two strips relative to the operating member giving strictly axial guidance of the latter, without a circular translational movement.

In a preferred embodiment of the invention, the operating member is moved by means of an actuator which can move axially, which acts on at least one flexible operating strip substantially perpendicular to the axis of movement of the operating member and able to transmit the movements of the actuator to this member.

The interposition of a flexible operating strip between the actuator and the operating member exhibits the advantage that any possible difference in axial travel between the actuator and the operating member can be compensated for through a deformation of the flexible operating strip.

In fact, if the actuator were to transmit to the operating member an axial movement over a distance which is greater than the length which separates its open position and its closed position, this could result in damage to the operating member or to the actuator.

Conversely, if the actuator were to transmit to the operating member a movement of too small an amplitude, this could result in the contact piece not being applied correctly to the contact terminals and in imperfect closure of the electrical path.

By virtue of the presence of a flexible operating strip between the actuator and the operating member, an actuator which has too great an axial travel relative to the length which the operating member is to travel can deliberately be used so as to guarantee that said operating member is moved over sufficient length to give good electrical contact, while safeguarding the operating member and the actuator against any risk of damage.

For the purpose of making the invention easier to understand, one embodiment given by way of non-limiting example will now be described with reference to the appended drawing in which:

DETAILED DESCRIPTION OF THE INVENTION

Figure 1:
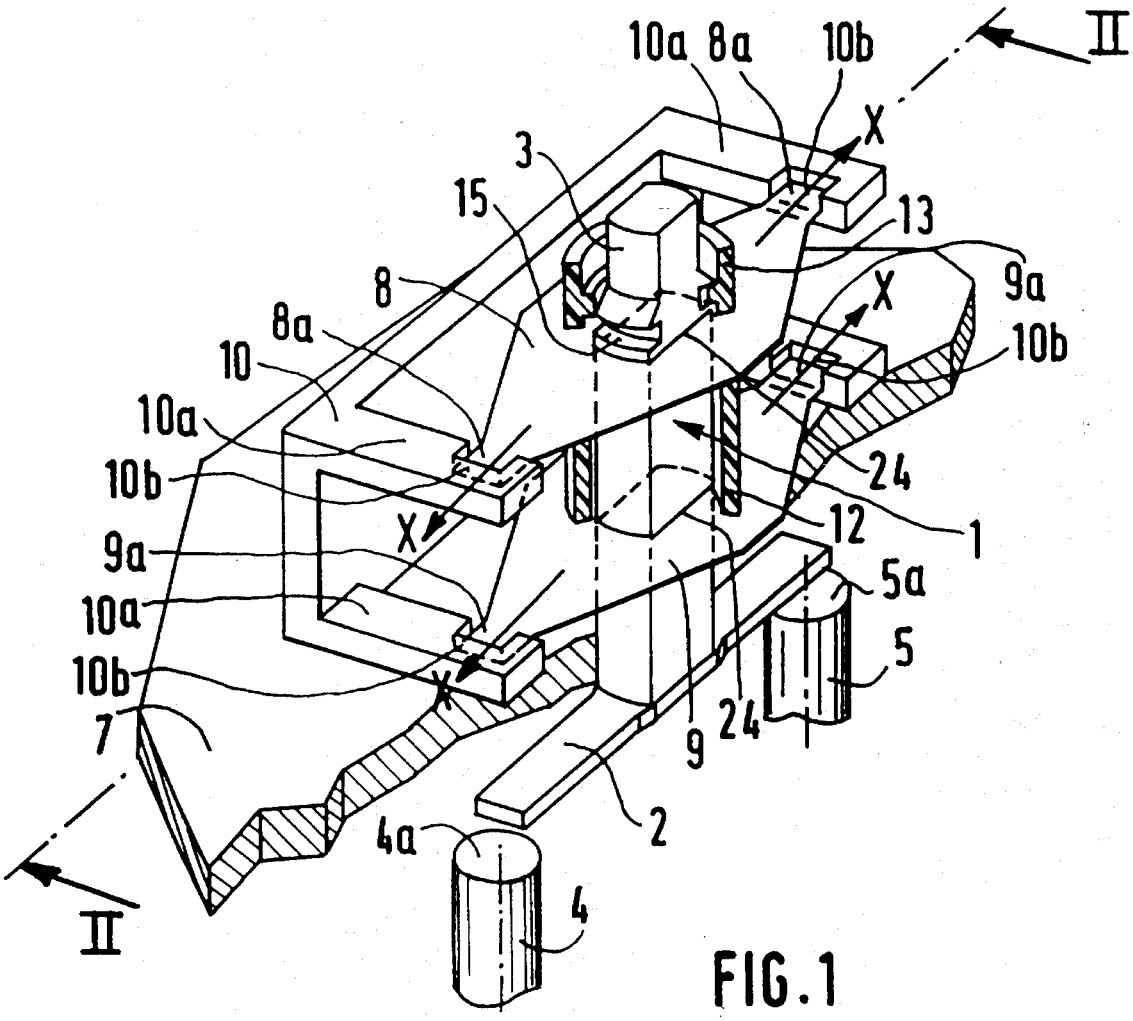
FIG. 1 represents in perspective a switching device according to one embodiment of the invention, in the open position.

The switching device represented in the drawing includes an operating member 1 which comprises an electrically conducting contact piece 2 and an electrically insulated pushbutton 3.

The pushbutton 3 is substantially cylindrical, whereas the contact piece 2 is in the form of a substantially rectangular metal strip.

The contact piece 2 is designed to be applied simultaneously to two contact terminals 4, 5 which exhibit contact surfaces 4*a*, 5*a* situated in one and the same plane parallel to the contact piece 2.

Figure 3:
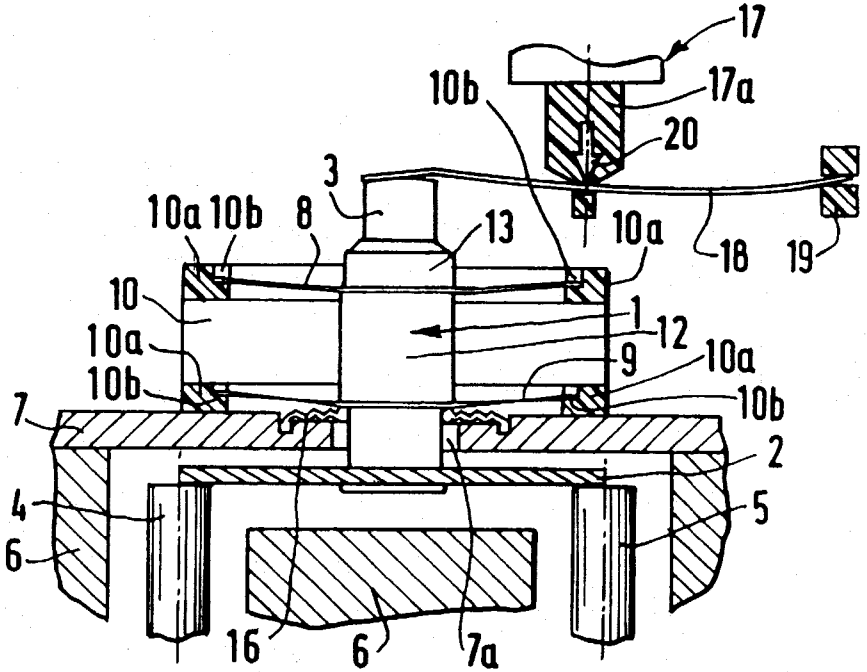
FIG. 3 is a view similar to FIG. 2, in the closed position.
Figure 2:
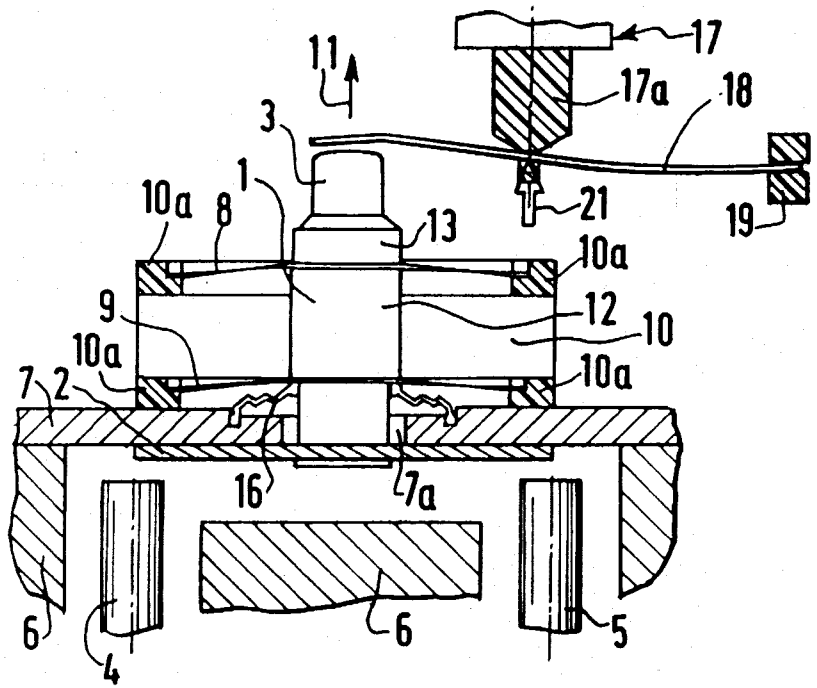
FIG. 2 is a view in section on II—II of FIG. 1.

As is clearly visible in the sectional views of FIGS. 2 and 3, the contact terminals 4 and 5 are each situated in a housing formed for this purpose in a conducting body 6, some distance from the wall of the housing, said terminals being electrically insulated from said body. The conducting body 6 includes an electrically conducting closure plate 7 in which an orifice 7*a* is made allowing of the pushbutton 3 to pass.

The electrical path formed by the two contact terminals 4, 5 and the contact piece 2 in thus protected from any electromagnetic radiation external to the switching device.

In accordance with the invention, the operating member 1 is integral with two parallel flexible strips 8 and 9, the overall lozenge shape of which can be seen in FIG. 1.

Each flexible strip is held at each of its ends 8*a*, 9*a*, in a cradle of a support 10.

The support 10 includes four parallel arms 10*a*, each one of which includes a cradle 10*b* designed to receive the end 8*a*, 9*a* of a flexible strip 8, 9, said end simply being placed in the cradle where it is immobilized owing to the fact that its dimensions are very slightly less than those of the cradle.

However, each end 8*a*, 9*a* is free to leave the cradle 10*b* in which it is housed.

It can clearly be seen, in the sectional views of FIGS. 2 and 3, that the two flexible strips 8, 9 constitute, on either side of the pushbutton 3, the two opposite sides of a parallelogram of which the pushbutton 3 constitutes a third side.

It can be understood that, thus supported by the strips 8 and 9, the pushbutton 3 can move only with an axial translational movement during which the flexible strips 8, 9 flex and remain mutually parallel.

It is also clearly apparent, especially from FIGS. 2 and 3, that the overall size of the switch is limited substantially to the separation of the two contact terminals, the support 10 being centered relative to the pushbutton 3.

FIG. 2 represents the switching device in the open position of the operating member, the contact piece 2 being separated from the contact terminals 4 and 5.

In the position of the switching device which is represented in FIG. 3, the pushbutton 3 is in the closed position of the operating member, the contact piece 2 being applied against the two contact terminals 4 and 5.

In this embodiment, the flexible strips 8, 9 each have a natural curvature which corresponds to that represented in FIG. 2.

In this way, the flexible strips 8, 9 permanently exert on the pushbutton 3 a force directed along its axis of movement in the direction indicated by the arrow 11 in FIG. 2.

The pushbutton 3 passes this force on to the contact piece 2 which is thus suitably applied against the closure plate 7.

Thus the contact piece 2 is prevented from making a coupling between the contact terminals 4 and 5 in the open position of the operating member.

Figure 4:
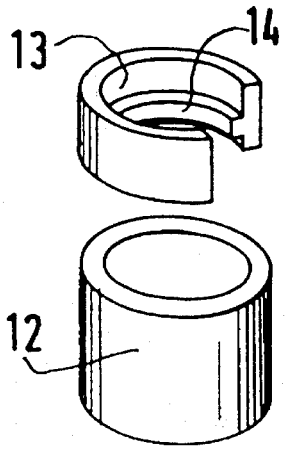
FIG. 4 represents, in perspective, a detail of FIG. 1.

FIG. 4 represents a structural example making it possible to secure the flexible strips 8, 9 to the pushbutton 3.

This is a cylindrical spacer piece 12 which is intended to be placed between the strips 8 and 9, and an open cylindrical bush 13.

The opening in the bush 13 has to be sufficiently large to allow it to be engaged, by a radial translational movement, over the upper part of the pushbutton 3.

An internal rib 14 of the bush 13 is capable, by a rotation of the bush 13, of interacting with a groove 15 provided on the pushbutton 3.

Owing to the fact that the curved strips 8, 9 permanently push the pushbutton 3 back in the direction of the arrow 11, there is no need to provide a limit stop between the lower part of the pushbutton 3 and the strip 9, the contact piece 2 fulfilling this limit stop function by being applied against the closure plate 7.

In this part of the pushbutton 3 situated close to the closure plate 7, a resilient annular membrane 16 achieven sealing between the pushbutton 3 and the closure plate 7.

In this way, not only does the switching device include no component which would be capable of producing dust by rubbing against another component, but, moreover, the membrane 16 affords protection to the contact parts of the device against any possible dust which may come in from outside and penetrate the casing 6 via the orifice 7*a*.

An actuator 17, for example an electromagnetic actuator, can move along an axis parallel to that of the pushbutton 3.

An operating strip 18, integral at one of its ends with a support 19 represented diagrammatically, passes through the end 17*a* of the actuator 17.

The other end of the operating strip 18 is situated close to the free end of the pushbutton 3.

It can be understood that the operating strip 18 is capable of transmitting to the pushbutton 3 the translational movements of the actuator 17 which are directed in the direction of the arrow 20 indicated in FIG. 3, in order to bring the operating member 1 into its closed position.

Conversely, when the actuator 17 moves in the direction of the arrow 21 indicated in FIG. 2, the operating strip 18 releases the pushbutton 3 and separates slightly therefrom in order to allow the pre-curved flexible strips 7, 8 to return the operating member 1 to its open position.

As already explained earlier, the presence of the operating strip 18 makes it possible to use an actuator 17 whose axial travel is slightly too great relative to that of the operating member 1, which makes it possible to guarantee optimum contact between the contact terminals 4, 5 and the contact piece 2.

In the embodiment which has just been described, it may be noted that the use of flexible strips makes it possible to orient the contact piece 2 suitably relative to the contact terminals 4 and 5.

Figure 5:
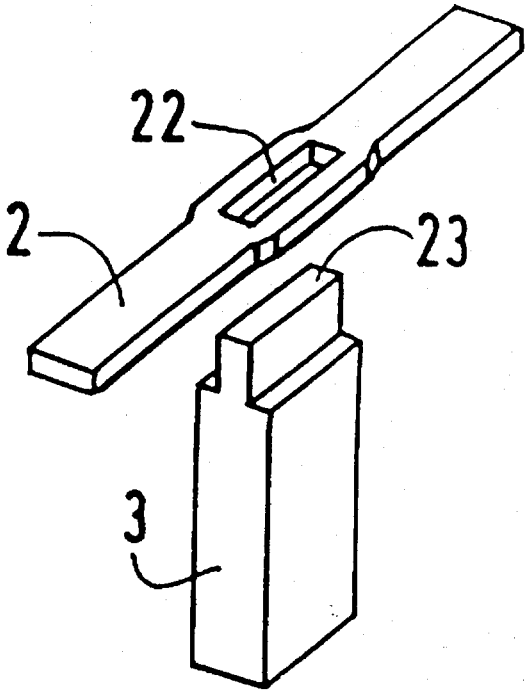
FIG. 5 is a view in perspective and from below of the contact piece and of the pushbutton of the two devices illustrated.
Figure 6:
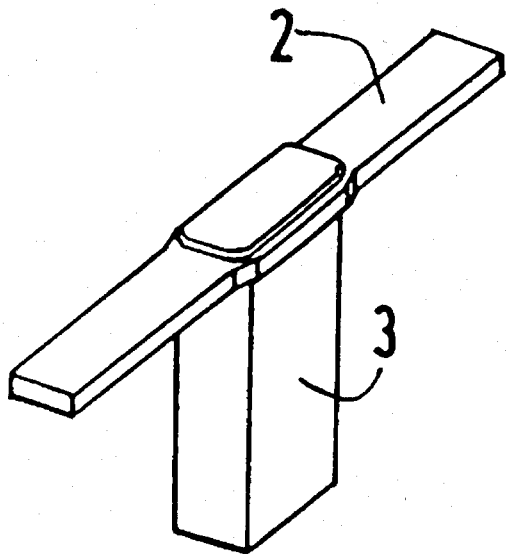
FIG. 6 is a view similar to FIG. 5, after the contact piece and pushbutton have been assembled.

In fact, as illustrated in FIGS. 5 and 6, which represent the pushbutton 3 and the contact piece 2 viewed from beneath relative to the previous figures, a rectangular slot 22 is cut out from the central part of the contact piece 2 while a tenon 23 of corresponding shape is provided at the end of the pushbutton 3.

After the tenon 23 has engaged in the slot 22, the tenon 23 is crushed, for example using a tool vibrating at high frequency, in order to secure the contact piece 2 and the pushbutton 3 together, as illustrated in FIG. 7.

A rotation-proof link between the pushbutton 3 and the flexible strips is also envisaged, as visible in FIG. 1, by giving the pushbutton a cross-section of substantially rectangular shape at least in its part where it joins on to the flexible strips, which are equipped with orifices 24 of corresponding shape.

It is clearly understood that the embodiments which have just been described have no limiting nature and that they can receive any desirable modifications whatever without thereby departing from the scope of the invention.

We claim:

1. A compact snap-action switch for high frequency switching applications comprising:

(a) a housing of electrically conductive material having a horizontal outer wall with an opening formed therein;

(b) two spaced contact terminals disposed within the housing and having contact surfaces in a common plane proximate to and parallel with the plane of said outer housing wall;

(c) a rectangular metal contact element adapted to bridge the gap between the contact surfaces of said contact terminals in a closed position and to be snapped into an open position spaced from said contact surfaces;

(d) an actuator element having a lower end portion supporting said rectangular metal contact element and having an upper end portion disposed above said housing;

(e) a cradle support for said operating member; two parallel flexible strips being freely supported therein and being secured to said operating member;

(f) said cradle support being mounted above said outer housing wall and accommodating limited vertical displacement of said operating member between a switch closing position in which said metal contact element contacts said spaced contact terminal surfaces and a switch opening position in which said metal contact element is spaced above said contact terminals;

(g) said parallel flexible strips normally biasing said operating member in a direction away from said contact surfaces;

(h) said parallel flexible strips being parallel to one another and forming with said operating member three sides of a parallelogram in a manner whereby the flexion of said flexible strips provides strictly axial translation of the operating member between the switch opening and the switch closing positions.

2. The compact snap-action switch of claim 1, further characterized in that (a) an axially displaceable actuator is provided in association with the upper end of said operating member;

(b) at least one flexible operating strip is arrayed substantially perpendicular to the axis of movement of the operating member;

(c) said actuator being displaceable against said flexible operating strip to displace the same simultaneously to move said operating member in a switch closing direction.

3. The compact snap-action switch of claim 1, further characterized in that (a) said operating member is insulated and in the form of a pushbutton.

4. The compact snap-action switch of claim 1, further characterized in that (a) a sealing means is disposed between the operating member and the horizontal outer wall of the housing.

5. The compact snap-action switch of claim 1, further characterized in that (a) said metal contact element bears against the horizontal housing wall in the switch open position.

* * * * *